US006375431B1

(12) United States Patent
Ando

(10) Patent No.: US 6,375,431 B1
(45) Date of Patent: Apr. 23, 2002

(54) EVACUATING APPARATUS

(75) Inventor: Kiyoshi Ando, Mie (JP)

(73) Assignee: Teijin Seiki Co., Ltd., Tokyo (JP)

( * ) Notice: Subject to any disclaimer, the term of this patent is extended or adjusted under 35 U.S.C. 154(b) by 0 days.

(21) Appl. No.: 09/713,170

(22) Filed: Nov. 15, 2000

(30) Foreign Application Priority Data

Nov. 17, 1999 (JP) ..... 11-326276
Jul. 13, 2000 (JP) ..... 2000-213110

(51) Int. Cl.[7] ..... F04B 49/06
(52) U.S. Cl. ..... 417/44.1; 418/104
(58) Field of Search ..... 417/44.1, 201, 417/203; 418/3, 201, 104

(56) References Cited

U.S. PATENT DOCUMENTS 4,714,418 A * 12/1987 Matsubara et al. ..... 418/201
4,781,553 A * 11/1988 Nomura et al. ..... 418/104
4,797,068 A * 1/1989 Hayakawa et al. ..... 417/201
4,954,047 A * 9/1990 Okuyama et al. ..... 417/203
5,549,463 A * 8/1996 Ozawa ..... 418/3
5,782,609 A * 7/1998 Ikemoto et al. ..... 417/44.1
5,836,746 A * 11/1998 Maruyama et al. ..... 417/44.1

FOREIGN PATENT DOCUMENTS

JP 09032766 * 2/1997 ..... F04C/25/02

* cited by examiner

*Primary Examiner*—Teresa Walberg
*Assistant Examiner*—Leonid M Fastovsky
(74) *Attorney, Agent, or Firm*—Akin, Gump, Strauss, Hauer & Feld, L.L.P.

(57) ABSTRACT

An evacuating apparatus having a high energy efficiency when the suction side pressure has reached the ultimate pressure or become a certain degree of vacuum, by decreasing the motive power owing to differential pressure. The evacuating apparatus (100) having a roughing vacuum pump (B) and a booster pump (A), each of which is constituted by a screw vacuum pump, wherein the design pumping speed of the roughing vacuum pump (B) is sufficiently smaller than the design pumping speed of the booster pump (A), but adequate to be operable as the roughing vacuum pump, and the number of turns of screw for the booster pump (A) is less than the number of turns of screw for the roughing vacuum pump (B).

7 Claims, 12 Drawing Sheets

EVACUATING APPARATUS

BACKGROUND OF THE INVENTION

The present invention relates to an evacuating apparatus for use to exhaust a vacuum chamber in the semiconductor manufacturing plant.

In the semiconductor vacuum devices, it is particularly important that an evacuated chamber can attain a degree of vacuum of about $10^{-3}$ Pa, and oil molecules must not enter the evacuated chamber. Thus, as a vacuum pump to meet such demands at a single stage, a screw vacuum pump (JP-B-7-9239) has been proposed which can exhaust the chamber from the atmospheric pressure to about $10^{-3}$ Pa at a single stage (with a high compression ratio and a wide operable pressure range), and is oil free.

However, the screw vacuum pump had the following intrinsic problems.

(1) The screw vacuum pump is small in conductance because a thread groove is used to receive and transfer molecules of gas to be exhausted. Accordingly, the pumping speed is slow in a molecular flow range.

(2) The screw vacuum pump is necessary to have a clearance between mating faces of the male and female screws, and between the outer periphery of a screw and the inner periphery of a housing. Accordingly, the vacuum sealing ability is bad, which has an adverse effect on the ultimate vacuum.

(3) The screw vacuum pump has a bad vacuum sealing ability, as described above, and when used as a roughing vacuum pump, takes a large motive power (power loss) to recompress and discharge a back streaming of air from the atmosphere side. In particular, for the screw vacuum pump having a high pumping speed, the total amount of clearance as defined in (2) becomes large, resulting in a great tendency of motive power loss. Further, when a screw pump is used as a roughing vacuum pump, the screw pump produces a large power loss, which is caused by a difference in pressure between the suction side and the atmosphere side, even though a necessary degree of vacuum has been already reached on the suction side.

For the above-mentioned problems intrinsic to the screw vacuum pump, the following solving means has been conventionally proposed.

(A) First, solving means for a problem of conductance of the item (1) has been proposed in which the screw vacuum pump is used as the roughing vacuum pump that is less problematical with the conductance, and the booster pump is a Roots vacuum pump having large conductance.

In this two-stage pump, however, because the Roots vacuum pump has a small compression ratio, the pumping speed of the screw pump as the roughing vacuum pump can not be made too small. Owing to the fact that the pumping speed of the roughing vacuum pump can not be reduced, it follows that the capacity of the motor for driving this roughing vacuum pump can not be reduced, and each motive power loss of (3) can not be decreased. (A problem of (2) still remains.)

(B1) Solving means of a problem regarding the sealing ability of (2) has been proposed in which a plurality of chambers for transferring the fluid are provided between the suction port and the exhaust port by providing a plural number of turns of screw in the screw pump used at a single stage, to enhance the sealing ability (JP-B-7-9239). However, such solving means has an increased axial length of the screw, so that the devices become larger. Further, the plural number of turns of screw will not simply lead to solving the problem (3).

(B2) Similarly, solving means of the problem regarding the sealing ability of (2) has been proposed in which a screw vacuum pump is used as the booster pump which is less problematical with the sealing ability and a diaphragm pump or oil-sealed rotary vacuum pump having good sealing ability is used as the roughing vacuum pump (JP-A-62-243982). Since the oil-sealed rotary vacuum pump is usually provided with a check valve at a discharge port, it is possible to prevent back streaming of the air from the atmosphere side, so that each motive power loss as in (3) can be reduced.

In such two-stage pump, however, since the diaphragm pump or oil-sealed rotary vacuum pump having good sealing ability is necessary to be used as the roughing vacuum pump, in a case of the diaphragm pump, for example, reaction products (which are produced from a reactive gas flowed through the evacuated chamber) are likely to remain in the inside of the pump. If the reaction products remain, the exhaust performance may degrade remarkably, and it takes a lot of time and cost for overhaul. Also, in a case of the oil-sealed rotary vacuum pump, there is the danger that the evacuated chamber may be contaminated with oil molecules, and there is the problem that the oil may degrade in short time owing to a reactive gas, or must be exchanged frequently.

(C1) Solving means of a problem regarding the motive power loss in (3) has been proposed in which a micro-pump having a very small pumping speed is provided on the exhaust side of the roughing screw vacuum pump (JP-A-7-119666, JP-A-10-184576). The pumping speed of this micro-pump is large enough to suck and exhaust the reactive gas of a minute amount (no more than 50 to 150 cc/min) flowed through the vacuum chamber (the pumping speed is one several hundredths or less that of the roughing vacuum pump). In other words, the pumping speed is set to be very small. Accordingly, since the inverse torque owing to the difference in pressure which acts on the micro-pump becomes also very small, the motive power loss becomes very small.

However, this solution is that the roughing screw vacuum pump exhausts continuously from the atmospheric pressure to a high vacuum state, i.e., from a viscous flow area of the gas to a molecular flow area. Accordingly, in order to improve the sealing ability in the viscous flow area (roughing exhaust), it is required that the number of turns of screw is increased, and the clearance between the screw and the housing is reduced. And in order to satisfy the pumping speed in the molecular flow area, a large gas transfer volume must be provided. Accordingly, the screw vacuum pump becomes large in the radial and axial directions, resulting in the severe problem of clearance variations owing to thermal expansion. Consequently, high precision machining of the screw and its screw accommodating chamber (housing) is necessary, leading to higher costs. Since the screw vacuum pump of large volume exhausts the gas near the atmospheric pressure, a motor for driving the screw vacuum pump must also have a large capacity.

(C2) Similarly, solving means of the problem of motive power loss in (3) has been proposed in which the screw vacuum pump is used at a single stage by having not only a plural number of turns of screw but also a small volume of the transfer chamber on the exhaust side, as shown in FIGS. 11 and 12. This conventional example will be described below to facilitate the understanding of this invention.

A rotor accommodating chamber 210*b* formed inside a housing 210 rotatably accommodates a main screw rotor 220 constituted of male and female screw rotors 220*m* and 220*f* having a ratio of teeth of 4 to 5, and a sub-screw rotor 230 constituted of another male and female screw rotors 230*m* and 230*f* having a ratio of teeth of 4 to 5.

If a motor 243 is rotated, the male rotors 230*m,* 220*m* connected to this motor 243 are caused to rotate, while at the same time the female rotors 220*f* and 230*f* are caused to rotate via the timing gears 241 and 242. In this way, if the main and sub rotors 220 and 230 are driven to rotate, the gas within the evacuated chamber is sucked through a suction port 210*a* into the inside of the housing 210, transferred and compressed, and exhausted to the outside through an exhaust port 210*c*.

By the way, the motive power required for a positive displacement vacuum pump 200 at the exhaust operation can be divided into a transfer motive power for transferring a sucked compressed fluid to the exhaust port 210*c,* a volume compression motive power owing to the volume of a transfer chamber of the positive displacement pump 200 being smaller from the suction port 210*a* to the exhaust port 210*c,* a motive power for transferring a compressed fluid that has flowed back through the clearance formed between the main screw rotor 220 or the sub-screw rotor 230 and the housing 210, from the high pressure side or exhaust side to the low pressure side or suction side, to the exhaust port 210*c* again, and a motive power (hereinafter referred to as a motive power owing to a differential pressure) against a force applied from the compressed fluid owing to a pressure difference between the suction side and the exhaust side.

The proportion of the motive power required for the positive displacement vacuum pump 220 at the exhaust operation may be different depending on the pressure of compressed fluid near the suction port 210*a* or near the exhaust port 210*c*. For example, when a vessel (hereinafter referred to as an evacuated vessel) of a fixed volume having an internal pressure equal to the atmospheric pressure is exhausted through the suction port 210*a* by the positive displacement vacuum pump 200, the pressure of compressed fluid neat the suction port 210*a* decreases with time, finally down to the ultimate pressure. However, when a small amount of gas may flow into the suction port 210*a,* the compressed fluid near the suction port 210*a* does not reach the ultimate pressure, but becomes a certain degree of vacuum. Accordingly, at the start of exhaust, the compressed fluid near the suction port 210*a* and that near the exhaust port 210*c* are both equal to the atmospheric pressure, and the required motive power is mainly a volume compression motive power. However, when the gas within the evacuated vessel has reached the ultimate pressure or become a certain degree of vacuum, there is a large difference in pressure between the compressed fluid near the exhaust port 210*c* and the compressed fluid near the suction port 210*a,* and the required motive power is mainly owing to a differential pressure.

Usually, since the vacuum pump is used to keep a vessel of fixed volume in vacuum in most cases, the motive power required when the vacuum pump is operating, i.e., the consumption motive power is mostly occupied by the motive power generated by the differential pressure. Accordingly, the energy saving of the vacuum pump can be effected by decreasing the motive power owing to differential pressure.

Herein, assuming that the torque of rotor is T, the rotating speed of rotor is N, and the constant is a, the consumption power W owing to differential pressure of each of the male and female rotors such as a screw vacuum pump can be given by the following expression (1).

$$W=a\times T\times N \tag{1}$$

Also, assuming that a pressure area at high pressure side converted in a direction parallel to an axis of rotation of rotor is A1, the average pressure at high pressure side is P1, the distance from the center of A1 area to the center of rotation of rotor is L1, the pressure area at low pressure side converted in the direction parallel to the axis of rotation of rotor is A2, the average pressure at low pressure side is P2, the distance from the center of A2 area to the center of rotation of rotor is L2, the torque T can be given by the following expression (2), where the high pressure side means the exhaust side and the low pressure side means the suction side.

$$T=A1\times P1\times L1-A2\times P2\times L2 \tag{2}$$

In the above expression (2), A1, A2, L1 and L2 can be varied depending on the structure of a vacuum pump. According to the expressions (1) and (2), the motive power W owing to differential pressure can be reduced by determining the structure of the vacuum pump so that the torque T be smaller.

However, in practice, A2 and L2 are dimensions which are necessarily determined if the pumping speed of the vacuum pump is set. When the gas within the evacuated vessel has reached the ultimate pressure or become a certain degree of vacuum, i.e., the pressure on suction side is lower to some extent, a force owing to the pressure of compressed fluid on suction side can be ignored. Accordingly, the motive power W owing to differential pressure can be decreased by reducing A1 and L1, i.e., the volume of the transfer chamber 230A (hereinafter referred to as an exhaust side transfer chamber) formed by a tooth space of the sub-screw rotor 230 and the housing 210 and in communication to the exhaust port 210*c* (atmospheric pressure).

However, in the conventional vacuum pump like the above, the outer diameter of the sub-screw rotor 230 that forms the exhaust side transfer chamber 230A and the inner diameter of the housing 210 were formed to be equal to the outer diameter of the main screw rotor 220 and the inner diameter of the housing 210, respectively. Therefore, it was difficult to reduce the volume of the exhaust side transfer chamber 230A to an optimal dimension, if the volume of a transfer chamber 220A (hereinafter referred to as a suction side transfer chamber) formed by a tooth space of the main screw rotor 220 and the housing 210 and immediately after having been blocked off the suction port 210*a* is designed to be great, to increase the design pumping speed (the value of gas transfer volume per revolution of an input shaft multiplied by a rotating speed per unit time of the input shaft).

That is, in the case of the screw pump, the gas transfer chamber is formed by mating the male and female rotors. Accordingly, in the conventional vacuum pump, since the outer diameter of the male and female rotors 220*m,* 220*f* forming the suction side transfer chamber 220A is equal to the outer diameter of the male and female rotors 230*m,* 230*f* forming the exhaust side transfer chamber 230A, an intermediate transfer chamber 230B having a lead angle θ2 may be reduced by making smaller the lead angle θ2 of the sub-screw rotor 230, as shown in FIG. 11, in order to reduce the volume of the exhaust side transfer chamber 230A. However, there is the working limitation on making the lead angle θ2 smaller. Consequently, the volume of the intermediate transfer chamber 230B could be reduced to only about ⅓ the volume of the suction side transfer chamber 220A. Owing to the fact that the volume of the intermediate chamber 230B can not be reduced, the volume of the exhaust side transfer chamber 230A can not be also reduced correspondingly. More specifically, the volume of the exhaust side transfer chamber 230A could be reduced to only about ⅕ the volume of the intermediate chamber 230B.

When a Roots or claw vacuum pump is concerned, the width of rotor in the axial direction must be decreased to reduce the volume of the exhaust side transfer chamber, but there is the limitation to decrease the width of rotor in the axial direction. If the volume of the suction side transfer chamber is designed to be great to increase the design pumping speed, it is difficult to reduce the volume of the exhaust side transfer chamber to the optimal dimension.

In this way, in the screw vacuum pump as shown in FIGS. 11 and 12, it was difficult to reduce the volume of the exhaust side transfer chamber to the optimal dimension. Therefore, the motive power owing to differential pressure could not be decreased, and the energy efficiency was low when the pressure on the suction side has reached the ultimate pressure or become a certain degree of vacuum.

Also, the axial length of screw is longer, leading to larger devices, as described in (B).

As described above, in the conventional evacuating apparatus using a screw vacuum pump, means for solving individually the problems intrinsic to the screw pump, i.e., concerning the conductance, sealing property, and consumption power, has been proposed, but there was no means for solving all the problems, and on one hand, such solving means gives rise to the new problem of larger devices or troublesome maintenance.

The present invention aims at solving the problems of such an evacuating apparatus using a screw vacuum pump.

BRIEF DESCRIPTION OF THE INVENTION

In order to solve the above-mentioned problems, the present invention provides an evacuating apparatus having a roughing vacuum pump and a booster pump, each of which is constituted of a screw vacuum pump, wherein the design pumping speed (a value of a gas transfer volume per revolution of an input shaft multiplied by a rotating speed per unit time of the input shaft) of the roughing screw vacuum pump is sufficiently smaller than the design pumping speed of the booster screw vacuum pump, but adequate to be operable as the roughing vacuum pump, the number of turns of screw (the number of turns of screw having more teeth when the numbers of teeth for the male and female screws are different) for the roughing screw vacuum pump is greater than the number of turns of screw for the booster screw vacuum pump.

1) With the above constitution, since the screw vacuum pump having a high compression ratio as the general characteristic is used as the booster pump, a great pumping speed can be achieved as a whole system, even though the design pumping speed of the roughing vacuum pump is insignificant (small).

2) Further, the design pumping speed of the roughing screw pump is sufficiently smaller than the design pumping speed of the booster pump, but adequate to be operable as the roughing vacuum pump. Accordingly, the booster pump has no need of having the capability of exhausting from the atmospheric pressure on the suction side, and can have a compact and simple structure. On the other hand, the roughing vacuum can reduce the motive power loss owing to differential pressure in a state where the suction side has reached the ultimate pressure or become a certain degree of vacuum.

3) Since the design pumping speed of the roughing screw pump is small enough as described above, its screw radius can be reduced. Accordingly, the variations of clearance due to thermal expansion caused axially can be diminished to make the clearance developed radially smaller. Consequently, the total leakage space of gas is reduced, and the sealing property can be improved.

4) In this way, since the sealing property of the roughing screw pump can be made better, there is no need of increasing the number of turns of screw to ameliorate the sealing property and the axial length of the roughing vacuum pump can be lessened.

5) Since the sealing property of the roughing vacuum pump can be ameliorated, a high degree of vacuum can be attained, and the axial length of the booster pump can be reduced, even if the number of turns of screw for the booster pump is small or the clearance between the screw and the housing is poor in precision.

6) Since the number of turns of screw for the booster pump can be reduced, the axial length may not become excessive by raising the lead angle of screw for the booster pump to increase the conductance.

7) Since the screw vacuum pump of simple structure is adopted for both the roughing vacuum pump and the booster pump, the exhaust passage is simpler and shorter. Accordingly, reaction products are unlikely to clog in the exhaust passage, and even if they clog or stick together, they can be easily removed and the easy maintenance is effected.

In an evacuating apparatus of the present invention, the design pumping speed of the roughing screw vacuum pump is ⅕ to 1/100 the design pumping speed of the booster screw vacuum pump.

With this constitution, the evacuating apparatus can be surely provided having a higher energy efficiency than the conventional one. The smaller the design pumping speed of the roughing screw vacuum pump with respect to the design pumping speed of the booster screw vacuum pump, the lesser the consumption power. But if the design pumping speed of the roughing vacuum pump is too low, there is the risk that the exhaust time is extended in a transient period where the evacuated vessel is exhausted from the atmospheric pressure to the ultimate pressure. Accordingly, in consideration of both the consumption power and the exhaust time, the design pumping speed of the roughing vacuum pump was made ⅕ to 1/100 the design pumping speed of the booster pump.

In the evacuating apparatus of this invention, the number of turns of screw for the booster screw vacuum pump is substantially one, or such that at least one gas transfer chamber which is in communication with neither the suction port nor the exhaust port of the booster pump is formed.

With this constitution, the axial length of the booster screw vacuum pump which may greatly affect the dimensions of the device can be substantially minimum, and the device can be made smaller.

In the evacuating apparatus of this invention, the number of turns of screw for the roughing screw vacuum pump is 3 to 10.

With this constitution, the sealing property of the evacuating apparatus can be maintained excellent as a whole, even if the sealing property of the booster screw vacuum pump may not be ameliorated, and the axial length of the roughing vacuum pump does not becomes too excessive.

In the evacuating apparatus of this invention, the screw lead angle of the booster screw vacuum pump is larger than the screw lead angle of the roughing vacuum pump.

With this constitution, the axial length of the booster screw pump is greater correspondingly with the lead angle, but the conductance can be increased. On one hand, the axial length of the roughing screw pump does not become greater.

In the evacuating apparatus of this invention, the roughing screw vacuum pump is only driven until the suction side pressure of the booster screw vacuum pump falls from the atmospheric pressure to about 13,300 Pa, and the booster pump starts to be driven when the suction side pressure of the booster screw vacuum pump has fallen below about 13,300 Pa.

With this constitution, the motive power required to drive the booster pump may be small, and the driving motor may have a small capacity.

In the evacuating apparatus of this invention, a driving motor for each of the booster screw vacuum pump and the roughing screw vacuum pump is rotated at as high a rotating speed as possible as far as the motor is not overloaded, to shorten the exhaust time, in a range where the suction side pressure of the booster screw vacuum pump is relatively high. When the suction side pressure of the booster screw vacuum pump has reached the ultimate pressure or become a relatively low pressure, the rotating speed of the driving motor for the booster screw vacuum pump is reduced to the lowest rotating speed to maintain a degree of vacuum required for the evacuated chamber, and the rotating speed of the driving motor for the roughing screw vacuum pump is reduced to as low a rotating speed as possible in a range where the back pressure of the booster pump can be maintained below its critical backing pressure, so that the necessary motive power is reduced.

With this constitution, the pumping speed in exhausting the evacuated chamber from the atmospheric pressure can be increased, and the consumption power can be reduced.

The present disclosure relates to the subject matter contained in Japanese patent application Nos. Hei. 11-326276 (filed on Nov. 17, 1999), and 2000-213110 (filed on Jul. 13, 2000), which are expressly incorporated herein by reference in their entireties.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

DETAILED DESCRIPTION OF THE INVENTION

The preferred embodiments of the present invention will be described below with reference to the drawings.

First Embodiment

Figure 1:
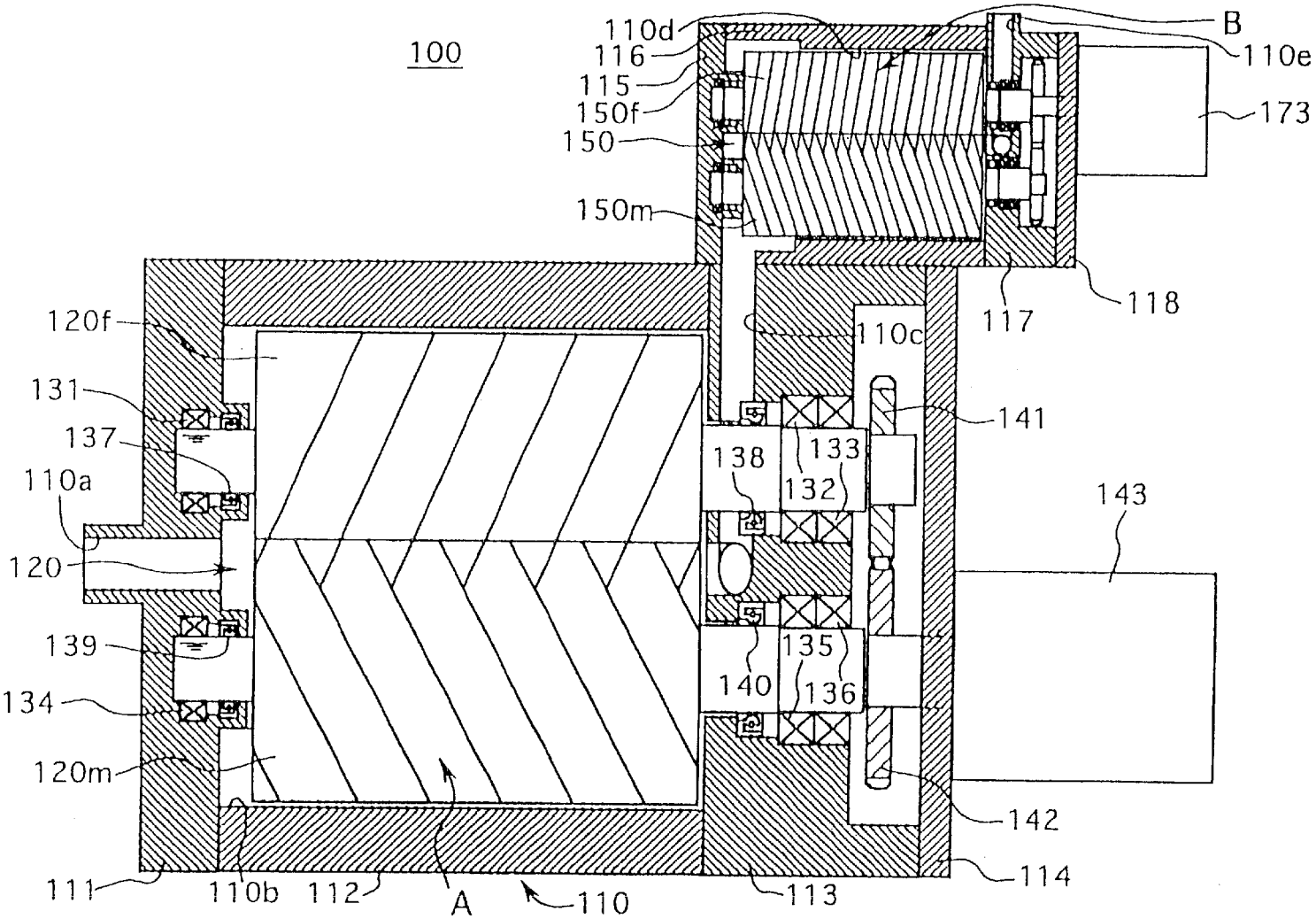
FIG. 1 is a cross-sectional view of an evacuating apparatus according to a first embodiment of the present invention.
Figure 2:
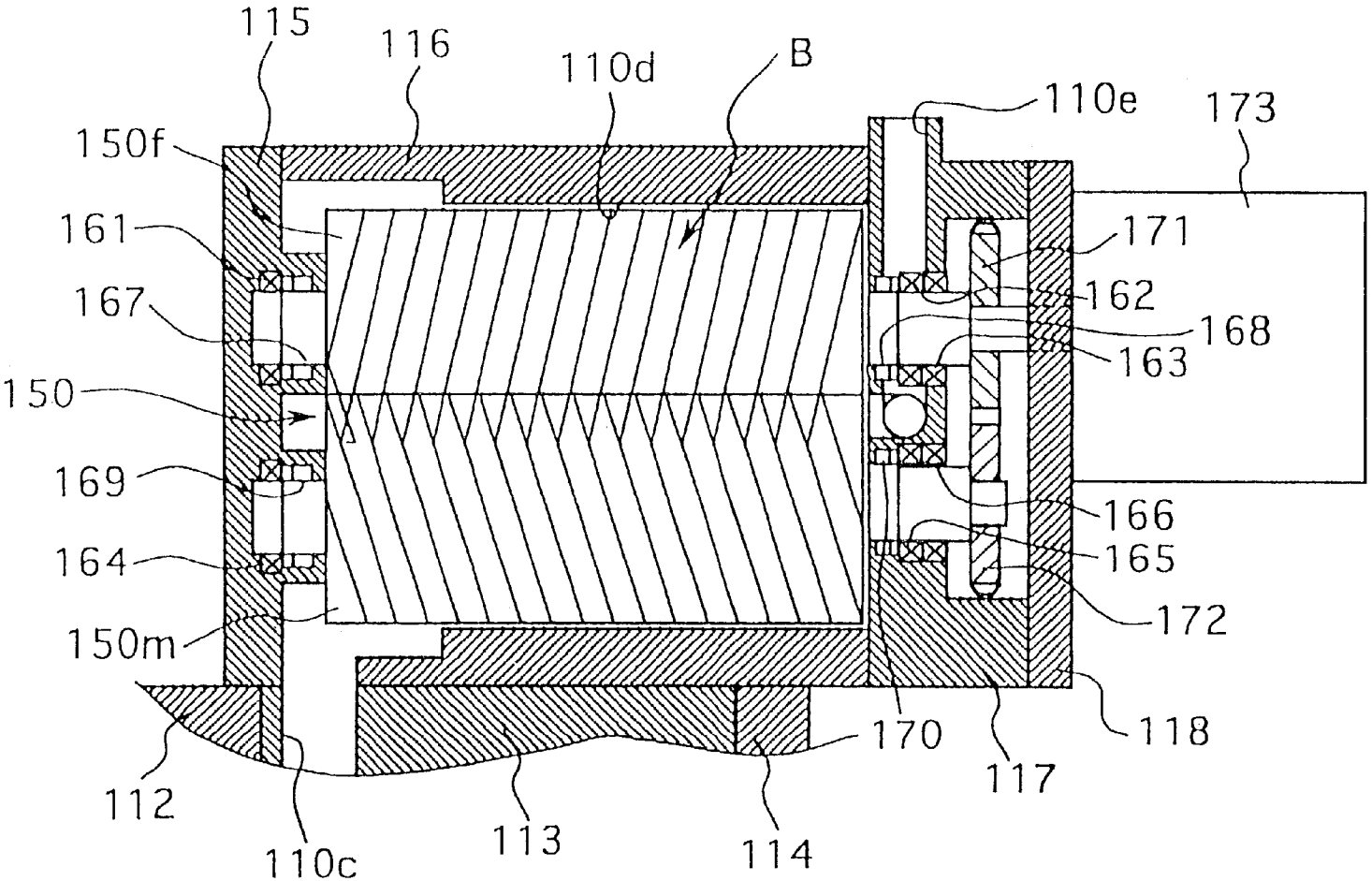
FIG. 2 is a partially enlarged cross-sectional view of the evacuating apparatus as shown in FIG. 1.
Figure 3:
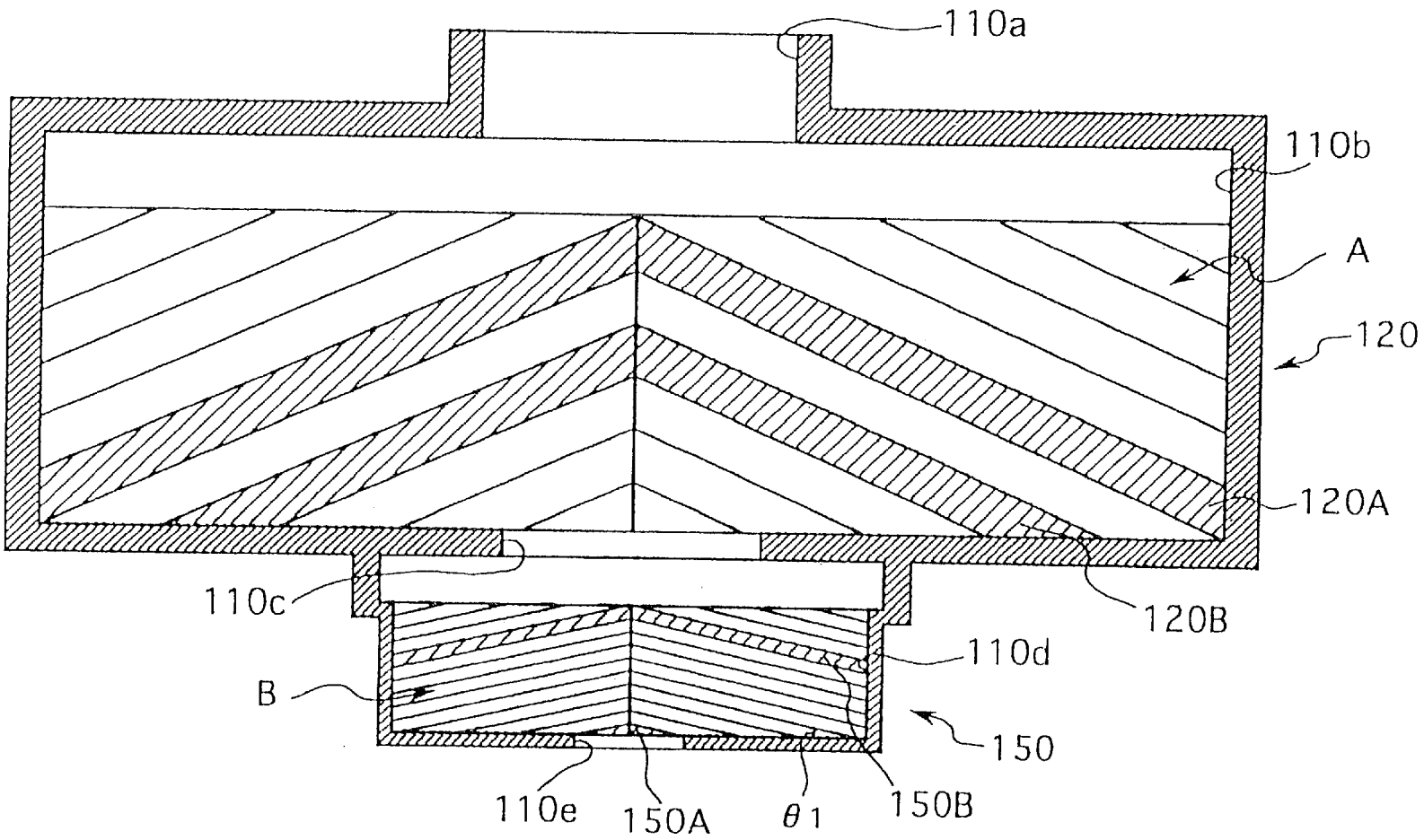
FIG. 3 is an expanded view of a screw portion in the evacuating apparatus as shown in FIG. 1.

Referring to FIGS. 1 to 3, explanation will be given of an evacuating apparatus 100 according to a first embodiment of the present invention.

The evacuating apparatus 100 is constituted of a screw vacuum pump A as a mechanical booster pump and a screw vacuum pump B as a roughing vacuum pump. In the terms used herein, "main" means a "booster screw vacuum pump" and "sub" means a "roughing screw vacuum pump".

The evacuating apparatus 100 comprises a main screw rotor 120 (screw rotor for the booster screw vacuum pump) and a sub screw rotor 150 (screw rotor for the roughing screw vacuum pump) that has a smaller outer diameter than the main screw rotor 120. The main screw rotor 120 is constituted of the male and female screw 10 rotors 120*m* and 120*f*, and the sub screw rotor 150 is constituted of the male and female screw rotors 150*m* and 150*f*.

The main screw rotor 120 is accommodated within a main rotor accommodating chamber 10b formed inside a housing 110. In more detail, a female rotor 120*f* is rotatably supported in the housing 110 by the bearings 131, 132 and 133, and a male rotor 120*m* is rotatably supported in the housing 110 by the bearings 134, 135 and 136. Here, the seals 137, 138, 139 and 140 prevent a lubricating oil of the bearings 131, 132, 133, 134, 135 and 136 from leaking into the main rotor accommodating chamber 110*b* as well as preventing the foreign matter from the main rotor accommodating chamber 110*b* entering into the bearings 131, 132, 133, 134, 135 and 136 by separating the bearings 131, 132, 133, 134, 135 and 136 from the main rotor accommodating chamber 110*b*.

The sub screw rotor 150 is accommodated within a sub rotor accommodating chamber 110*d* formed inside the housing 110. In more detail, a female rotor 150*f* is rotatably supported in the housing 110 by the bearings 161, 162 and 163, and a male rotor 150*m* is rotatably supported in the housing 110 by the bearings 164, 165 and 166. Here, the seals 167, 168, 169 and 170 prevent a lubricating oil of the bearings 161, 162, 163, 164, 165 and 166 from leaking into the sub rotor accommodating chamber 110*d* as well as preventing the foreign matter from the sub rotor accommodating chamber 110*d* entering into the bearings 161, 162, 163, 164, 165 and 166 by separating the bearings 161, 162, 163, 164, 165 and 166 from the sub rotor accommodating chamber 110*d*.

Herein, the volume of an exhaust side transfer chamber 150A for the roughing vacuum pump B is designed to be ⅕ or less the volume of a suction side transfer chamber 120A for the booster pump A.

A design pumping speed (a value of the gas transfer volume per revolution of an input shaft multiplied by the rotating speed per unit time of the input shaft) of the screw vacuum pump B as the roughing vacuum pump is 420 litters/min (a rated rotating speed of 4500 rpm for a motor 173), and a design pumping speed of the screw vacuum pump A as the mechanical booster pump is 8500 L/min (a rated rotating speed of 6800 rpm for a motor 143). In other words, the design pumping speed of the roughing vacuum pump B is designed to be about 1/20 (about 1/13 when converted in the ratio of the gas transfer volume per revolution of the input shaft) the design pumping speed of the booster pump A. In this way, as the design pumping speed of the roughing vacuum pump B is smaller than that of the booster pump A, the volume of the exhaust side transfer chamber 150A for the roughing vacuum pump B which is in communication to the atmosphere is correspondingly smaller, as shown in FIG. 3. Accordingly, the volume of the exhaust side transfer chamber 150A for the roughing vacuum pump B is sufficiently smaller than that of the suction side transfer chamber 120A for the booster pump A. The relation between a right end face of the exhaust side transfer chamber 150A for the roughing vacuum pump B in communication to the atmosphere in FIG. 3 and a left end face of the exhaust port 110e in FIG. 3 (an inner wall of the housing) is designed such that a required exhaust passage area is secured while the volume of the exhaust side transfer chamber 150A in communication to the atmosphere is minimum. More specifically, the volume of the exhaust side transfer chamber 150A can be reduced to about ⅕ the volume of the suction side transfer chamber 150B of the roughing vacuum pump itself.

The main rotor accommodating chamber 110*b* is formed on a wall portion of the housing 110, and in communication with the outside of the housing 110 through a suction port 110*a* for sucking the compressed fluid from the outside of the housing 110 into the inside of the housing 110. The main rotor accommodating chamber 110*b* and the sub rotor accommodating chamber 110*d* are communicated through a communication passage 110*c* formed within the housing 110. The sub rotor accommodating chamber 110*d* is formed on a wall portion of the housing 110, and in communication with the outside of the housing 110 through an exhaust port 110*e* for exhausting the compressed fluid from the inside of the housing 110 to the outside of the housing 110. Herein, the suction port 110*a* is in communication with the evacuated chamber of a fixed volume, not shown, and the exhaust port 110*e* is in communication with the atmosphere.

At one end portions of the male and female rotors 120*m* and 120*f* for the main screw rotor 120, timing gears 141 and 142 for rotating one rotor along with the rotation of the other rotor are secured to mate each other. Further, at one end portion of a male rotor 120*m*, a main motor 143 is integrally linked.

At one end portions of the male and female rotors 150*m* and 150*f* for the sub screw rotor 150, timing gears 171 and 172 for rotating one rotor along with the rotation of the other rotor are secured to mate each other. Further, at one end portion of a female rotor 150*f*, a sub motor 173 is integrally linked.

The housing 110 is constructed by a main housing first member 111, a main housing second member 112, a main housing third member 113, a main housing fourth member 114, a sub housing first member 115, a sub housing second member 116, a sub housing third member 117 and a sub housing fourth member 118.

The main side male and female rotors 120*m*, 120*f* has a screw teeth ratio of 5 to 6, and the sub side male and female rotors 150*m*, 150*f* has also a screw teeth ratio of 5 to 6. The number of turns of screw for the main side male and female rotors 120*m*, 120*f* is one ("the number of turns 1" as referred herein means the number of turns for the female screw 120*f* (the number of teeth 6), "the number of turns" means the number of turns of screw having more teeth when the male and female screws have different numbers of teeth), and the number of turns of screw for each of the sub side male and female rotors 150*m* and 150*f* is five. The screw lead angle of the main side female rotor 120*f* is about 45 degrees, and the screw lead angle of the sub side female rotor 150*f* is about 12 degrees.

Herein, the number of turns of screw for the main side male and female rotors 120*m*, 120*f* is substantially one, or such that at least one gas transfer chamber (e.g., an enclosed chamber in a compression process as indicated at 120B in FIG. 3) which is in communication with neither the suction port 110*a* nor the exhaust port 110*c* is formed. This is because the booster pump A in this embodiment has no need of better sealing property from the relationship between the design pumping speed of the roughing vacuum pump B and the sealing property.

The operation of the evacuating apparatus 100 according to this embodiment of the invention will be described below.

First, explanation will be given of an instance where the gas within an evacuated vessel (not shown) is exhausted by the roughing screw vacuum pump B until the pressure within the evacuated vessel is reduced from near the atmospheric pressure to about 13,300 Pa.

The male and female rotors 150*m*, 150*f* are rotated by driving the sub motor 173, so that the gas within the evacuated chamber is exhausted. Then, the gas within the evacuated chamber is sucked through the suction port 110*a* of the booster pump A and via the booster pump A and the communication passage 110*c* by the roughing vacuum pump A, and exhausted through the exhaust port 110*e* to the atmosphere.

When the suction side pressure of the booster screw vacuum pump A falls below about 13,300 Pa, the booster pump A starts to be driven while the rotation of the rotors 150*m*, 150*f* for the roughing screw vacuum pump B is maintained. That is, the male and female rotors 120*m* and 120*f* are caused to rotate by driving the main motor 143, so that the gas within the evacuated chamber that has been diluted is transferred and exhausted to the roughing vacuum pump B. The roughing vacuum pump B further transfers and compresses the gas transferred from the booster pump A and exhausted through the exhaust port 110*e* to the atmosphere. In this way, the pressure of the evacuated vessel is reduced to the ultimate pressure.

Herein, since the booster pump A exhausts the gas having low pressure, it suffices that the motive power required to drive the booster pump A is small, and the driving motor can have a small capacity.

The vacuum pump 100 is designed such that the design pumping speed of the screw vacuum pump B as the roughing vacuum pump is 420 L/min (a rated rotating speed of 4500 rpm for the motor 173) and the design pumping speed of the screw vacuum pump A as the booster pump is 8500 L/min (a rated rotating speed of 6800 rpm for the motor 143). That is, since the design pumping speed of the roughing vacuum pump B is designed to be about 1/20 that of the booster pump A, the motive power owing to differential pressure can be smaller than the conventional one, and the energy efficiency can be improved when the suction side pressure has reached the ultimate pressure or become a certain degree of vacuum.

In this way, for a better understanding of the evacuating apparatus of this embodiment which allows the improvements in the energy efficiency, and the compact construction of the device, explanation will be given of a Roots vacuum pump applied to a mechanical booster pump as the comparison.

When the Roots vacuum pump is used for the booster pump, the pumping speed of the roughing vacuum pump must be increased, because the Roots vacuum pump has a small compression ratio (ratio of exhaust side pressure to suction side pressure) of about 10 to 1. For example, considering a booster pump having a pumping speed of 4,000 L/min when the suction side pressure is 1 Pa, if a gas is flowed at 4,000 Pa·L/min from the suction port of the booster pump in the condition where the suction side pressure of the booster pump is 1 Pa, the exhaust port pressure of the booster pump becomes about 10 Pa from the relation of the compression ratio. Thus, the roughing vacuum pump in this system is required to have a pumping speed of 400 L/min or greater when the suction port pressure is about 10 Pa, and becomes a large capacity pump because the design pumping speed is 1000 L/min or greater. For example, in the case of using a screw pump, the groove, diameter and length of the screw are increased. In other words, A1 and L1 in the previous expression (2) are increased. In this way, if the roughing vacuum pump has a large capacity, the consumption power (derived from the expression (2)) owing to differential pressure is also increased naturally.

On the contrary, when a screw vacuum pump was used for the booster pump, the experiments revealed that the compression ratio was 1 to 100 or more in the intermediate and high vacuum regions and was very large. From this, under the same conditions as above (considering a booster pump having a pumping speed of 4,000 L/min when the suction side pressure is 1 Pa, a gas is flowed at a rate of 4000 Pa·L/min from the suction port of the booster pump in the condition where the suction side pressure of the booster pump is 1 Pa) the exhaust side pressure can be as high as about 100 Pa, when the screw vacuum pump is used for the booster pump. Thus, the roughing vacuum pump in this system may have a pumping speed as small as about 40 L/min when the suction port pressure is 100 Pa, and also a small design pumping speed. Accordingly, the gas transfer volume of the roughing screw vacuum pump can be sufficiently small. In this way, if the transfer volume of the roughing vacuum pump can be reduced, the groove, diameter and length of the screw can be naturally reduced, namely, A1 and L1 in the previous expression (2) can be reduced, so that the consumption power owing to differential pressure can be significantly cut down.

Herein, the smaller the design pumping speed of the roughing screw pump B with respect to the design pumping speed of the booster screw pump A, the lesser the consumption power. But if the design pumping speed of the roughing vacuum pump is too small, there is the inconvenience that the exhaust time is longer in a transient period where the evacuated vessel is exhausted from the atmospheric pressure to the ultimate pressure. Accordingly, in view of both the consumption power and the exhaust time, the design pumping speed of the roughing vacuum pump B is preferably 1/5 to 1/100 the design pumping speed of the booster pump A.

In this way, since the design pumping speed of the roughing screw pump B is sufficiently reduced, the outer diameter of the screw can be lessened. Accordingly, since the variations of clearance owing to thermal expansion developed radially are less significant, the radial clearance can be further reduced. As a result, the total leakage space of gas is small, and the sealing property can be improved. Therefore, the roughing screw pump B has no need of increasing the number of turns of screw to improve the sealing property. And the axial length can be lessened. Further, even if the number of turns of screw for the booster pump A is reduced and the clearance between the screw and the housing is poor in precision, a high degree of vacuum can be obtained, and the axial length of the booster screw pump A can be lessened.

Herein, in view of the ultimate vacuum and the axial length, the number of turns of screw for the male and female screws **120*m*, 120*f* in the booster screw pump A is substantially one, or such that at least one gas transfer chamber which is in communication with neither the suction port nor the exhaust port of the booster pump is formed. The number of turns of screw for the male and female screws 120*m*, 120*f*** in the roughing screw pump B should be greater in respect of the sealing property, but in the present invention, may be about 3 to 10 because the sealing property is excellent as described above.

In this way, since the axial length of the booster pump A can be lessened, the axial length does not become excessive even if the lead angle of screw for the booster pump A is raised to increase the conductance.

Herein, the lead angle of the female screw **120*f* in the booster screw pump A is preferably about 30 to 60 degrees to make it easier for gas molecules on the suction side to enter the screw groove. In particular, to promote the knock-on effect of gas molecules on the suction side with the tooth surface of screw, the lead angle of the female screw 120*f* is preferably near 45 degrees. The lead angle of the female screw 150*f*** in the roughing screw pump B is not necessarily increased, and may be about 8 to 15 degrees in view of the machining and the axial length.

Since the screw vacuum pump with a simple structure is employed as the roughing vacuum pump, the exhaust passage is simpler and shorter. Accordingly, reaction products are unlikely to clog in the exhaust passage, and even if they clog or stick together, they can be removed and the easy maintenance is effected.

Figure 11:
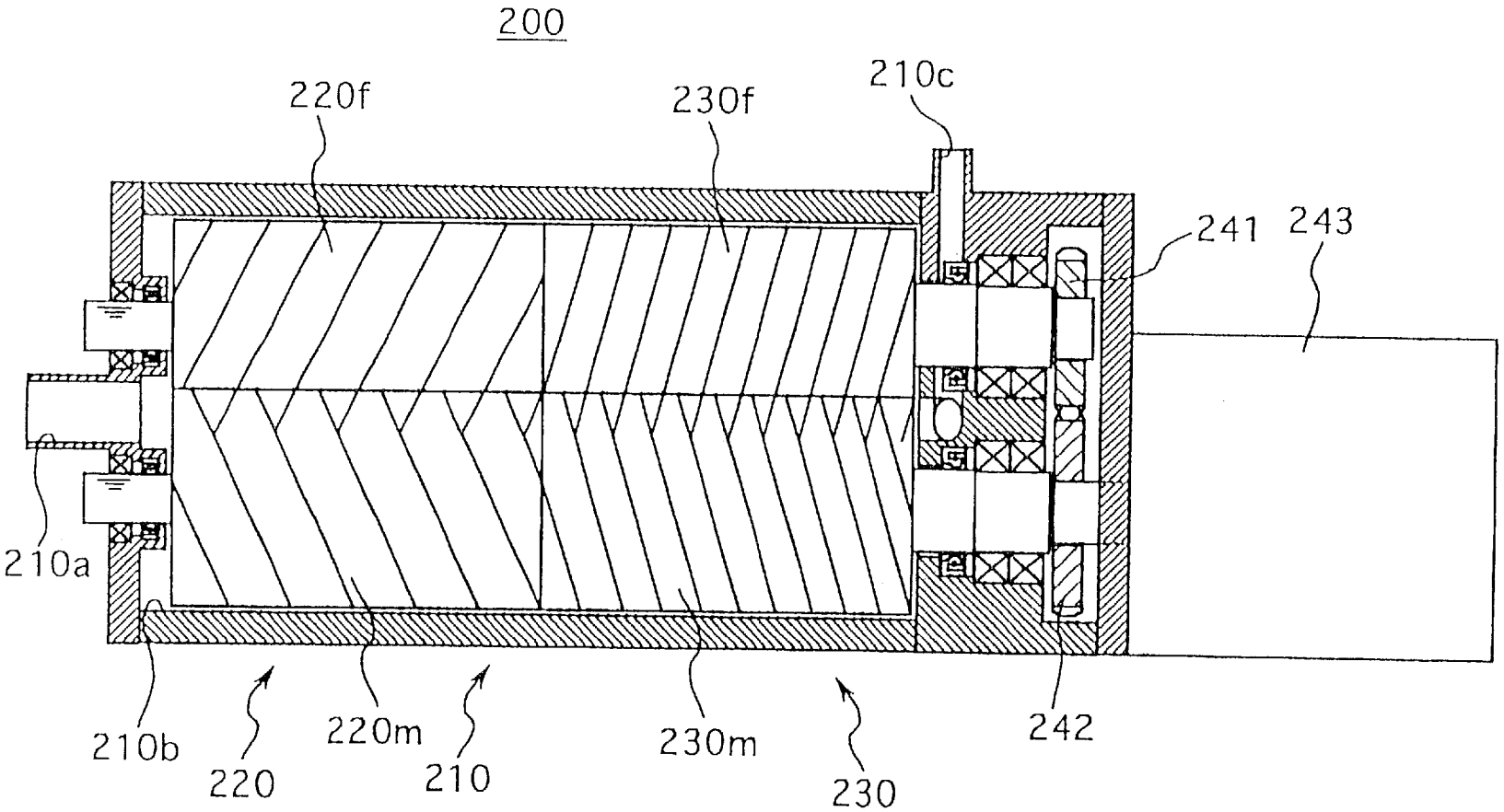
FIG. 11 is a cross-sectional view of the conventional vacuum pump.
Figure 12:
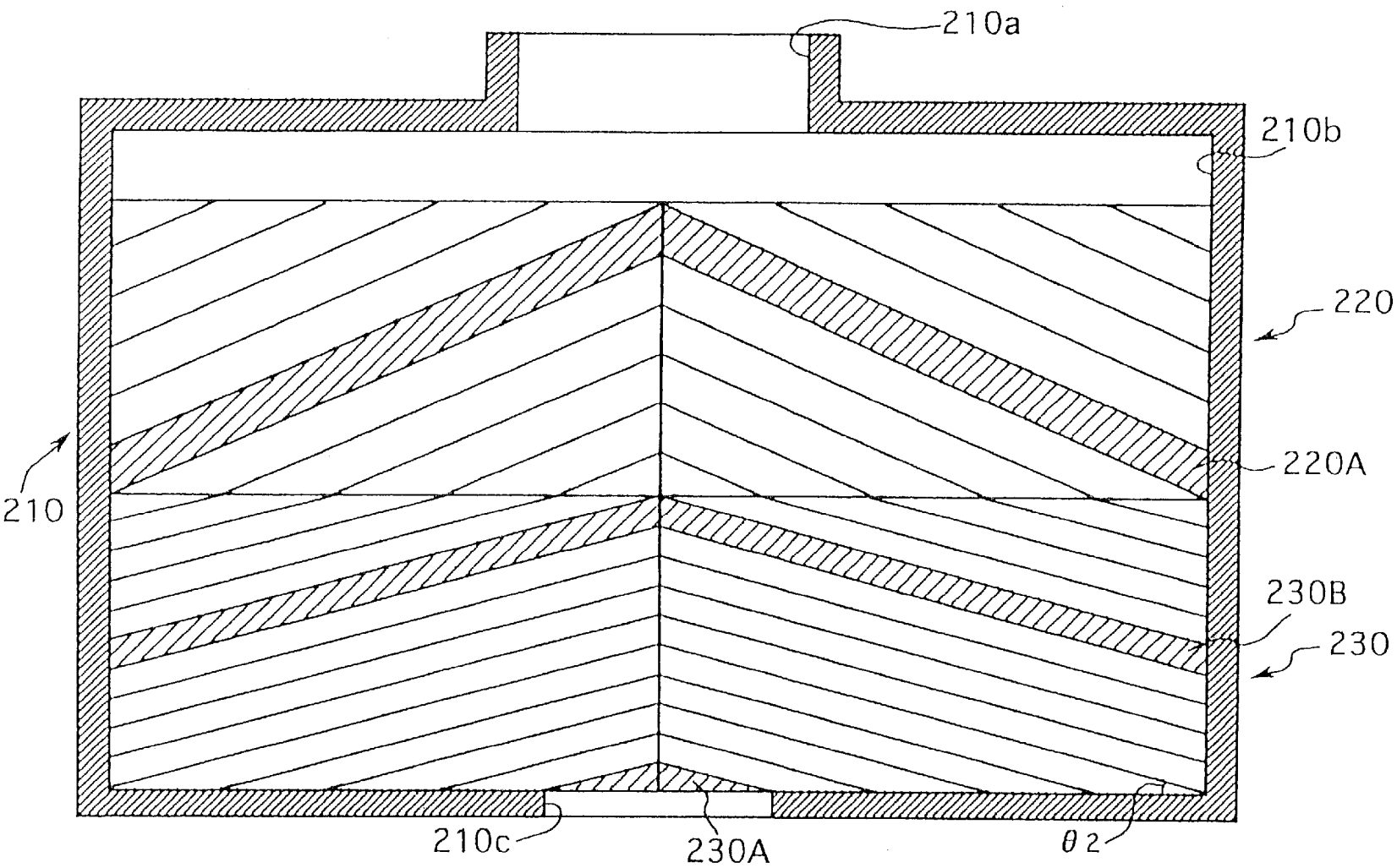
FIG. 12 is a development view of a screw portion in the evacuating apparatus as shown in FIG. 11.

In the evacuating apparatus 100 of this embodiment, since the axis of rotation of the main screw rotor 120 is different from the axis of rotation of the sub screw rotor 150, their rotors can be designed with a greater degree of freedom than the conventional example as shown in FIG. 11. Accordingly, the main screw rotor 120 allows the screw of a large outer diameter and lead to be designed, so that the suction conductance maybe increased. Also, the sub screw rotor 150 allows the screw having a small outer diameter and a lead angle θ1 to be designed appropriately for machining, so that the motive power owing to differential pressure may be small, namely, the exhaust side transfer chamber 150A may have a small capacity, and in view of the sealing property, workability and rotational balance.

Second Embodiment

Referring to FIGS. 4 to 8, explanation will be given of an evacuating apparatus 300 according to a second embodiment of the invention. The points that are substantially different from the first embodiment are only described here, but the same configuration as the first embodiment is not described anymore.

Figure 4:
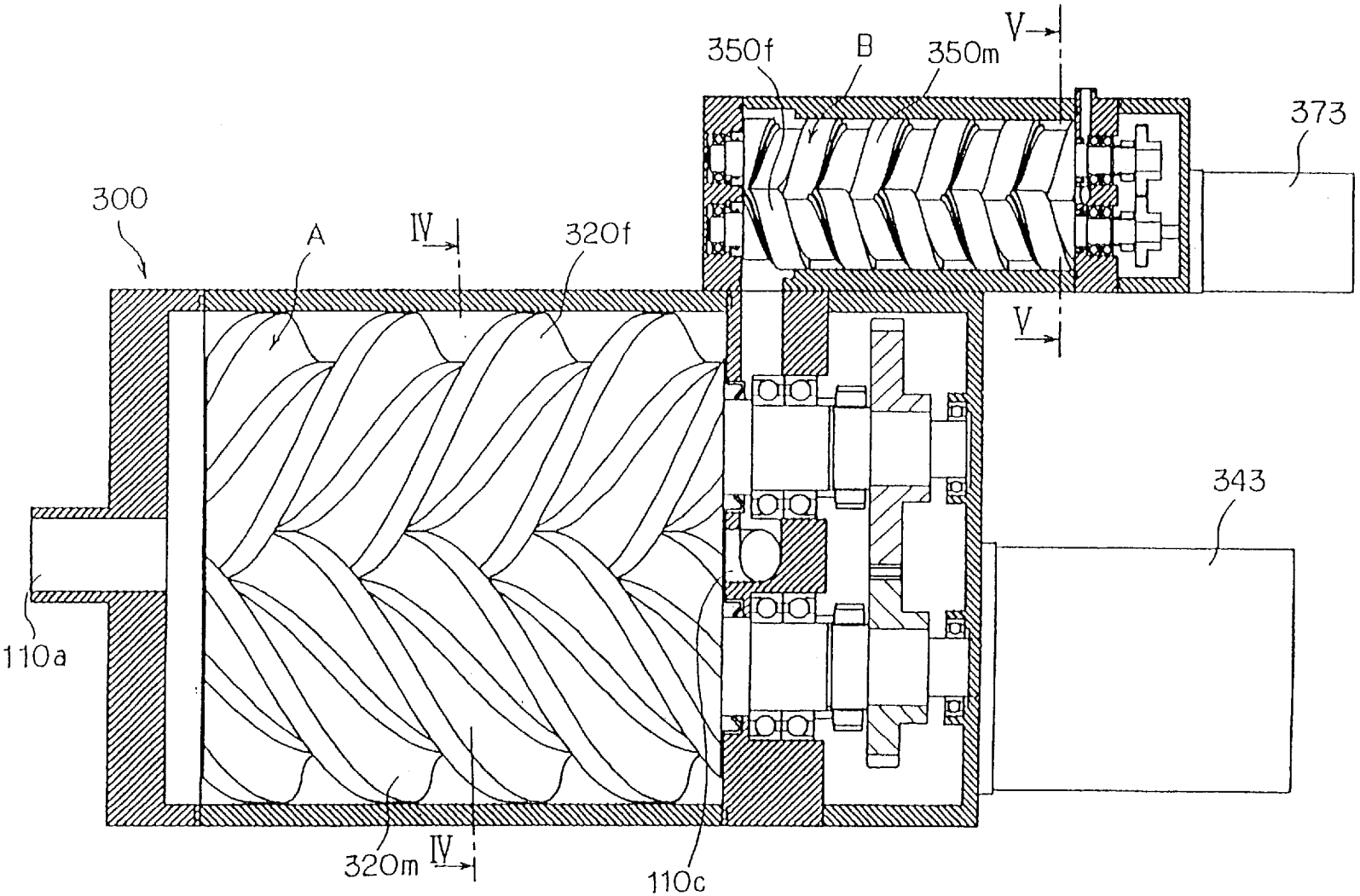
FIG. 4 is a cross-sectional view of an evacuating apparatus according to a second embodiment of the invention.

In the evacuating apparatus 300 according to the second embodiment of the invention as shown in FIG. 4, the male and female screw rotors 320*m* and 320*f* of the booster pump A are constructed in a cantilever form, in which back diffusion of a bearing lubricating oil into the vacuum chamber can be eliminated by dispensing with the bearings and the oil seals on the suction side, and the suction conductance can be improved without blocking the passage into which the gas flows.

Figure 5:
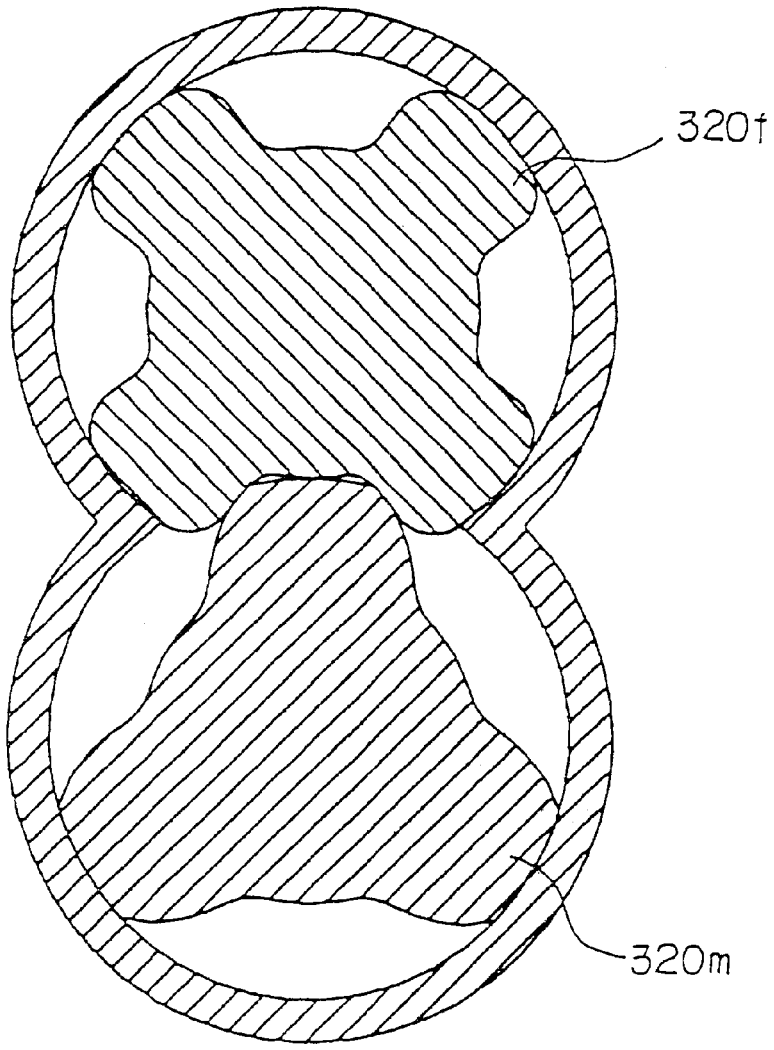
FIG. 5 is a cross-sectional view taken along the arrow IV—IV of FIG. 4, showing the plane of rotation of the male and female screws 320*m*, 320*f* in cross section.
Figure 6:
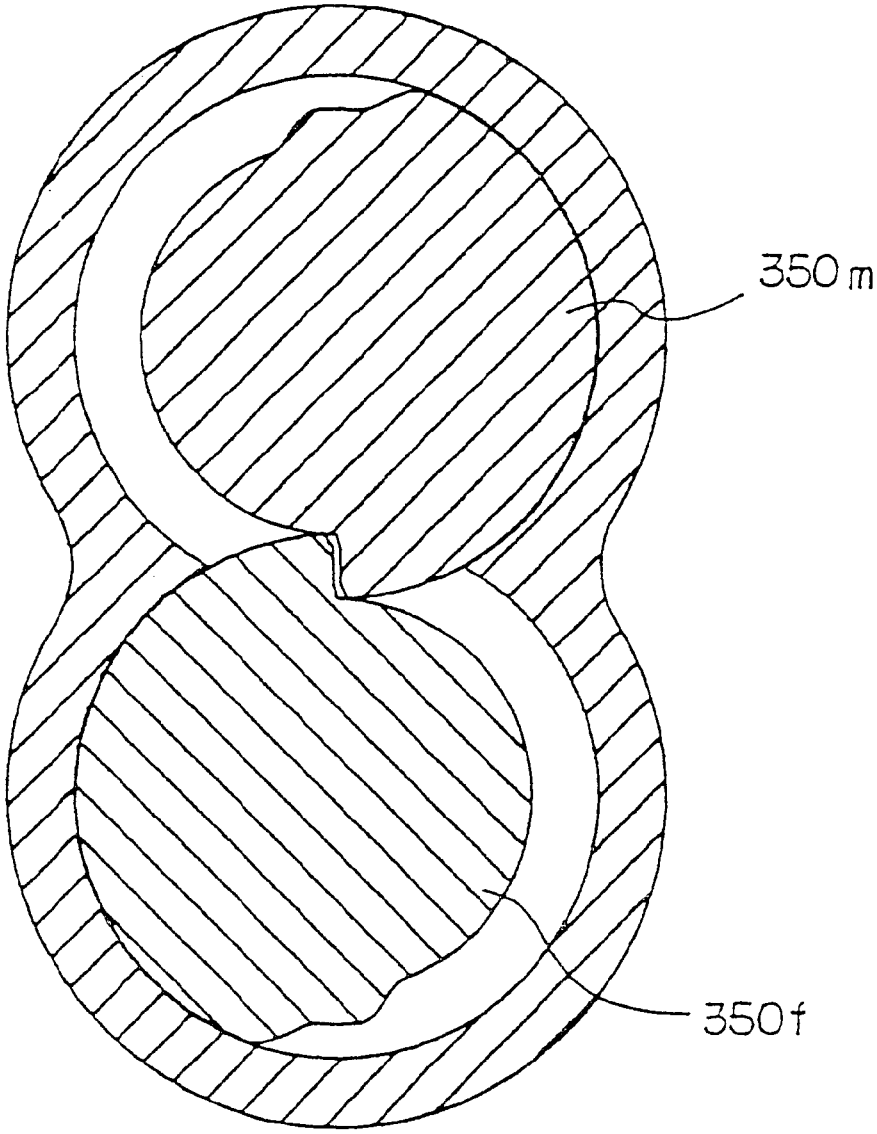
FIG. 6 is a cross-sectional view taken along the arrow IV—IV of FIG. 4, showing the plane of rotation of the male and female screws 350*m*, 350*f* in cross section.

The ratio of teeth of screw for the male and female screw rotors 320*m* and 320*f* in the booster pump A is configured to be 3 to 4, and the number of turns of screw is one, as shown in FIG. 5. On one hand, the ratio of teeth of screw for the male and female screw rotors 350*m* and 350*f* is configured to be 1 to 1, and the number of turns of screw is five, as shown in FIG. 6.

The design pumping speed of the roughing vacuum pump B is about 1/20 the design pumping speed of the booster pump A, as in the first embodiment. The operation of the evacuating apparatus 300 according to the second embodiment of the invention is the same as in the first embodiment.

Herein, the preferable methods of operating the evacuating apparatus 300 according to the second embodiment (or similarly the first embodiment) will be described below.

(Operation Method 1)

Figure 7:
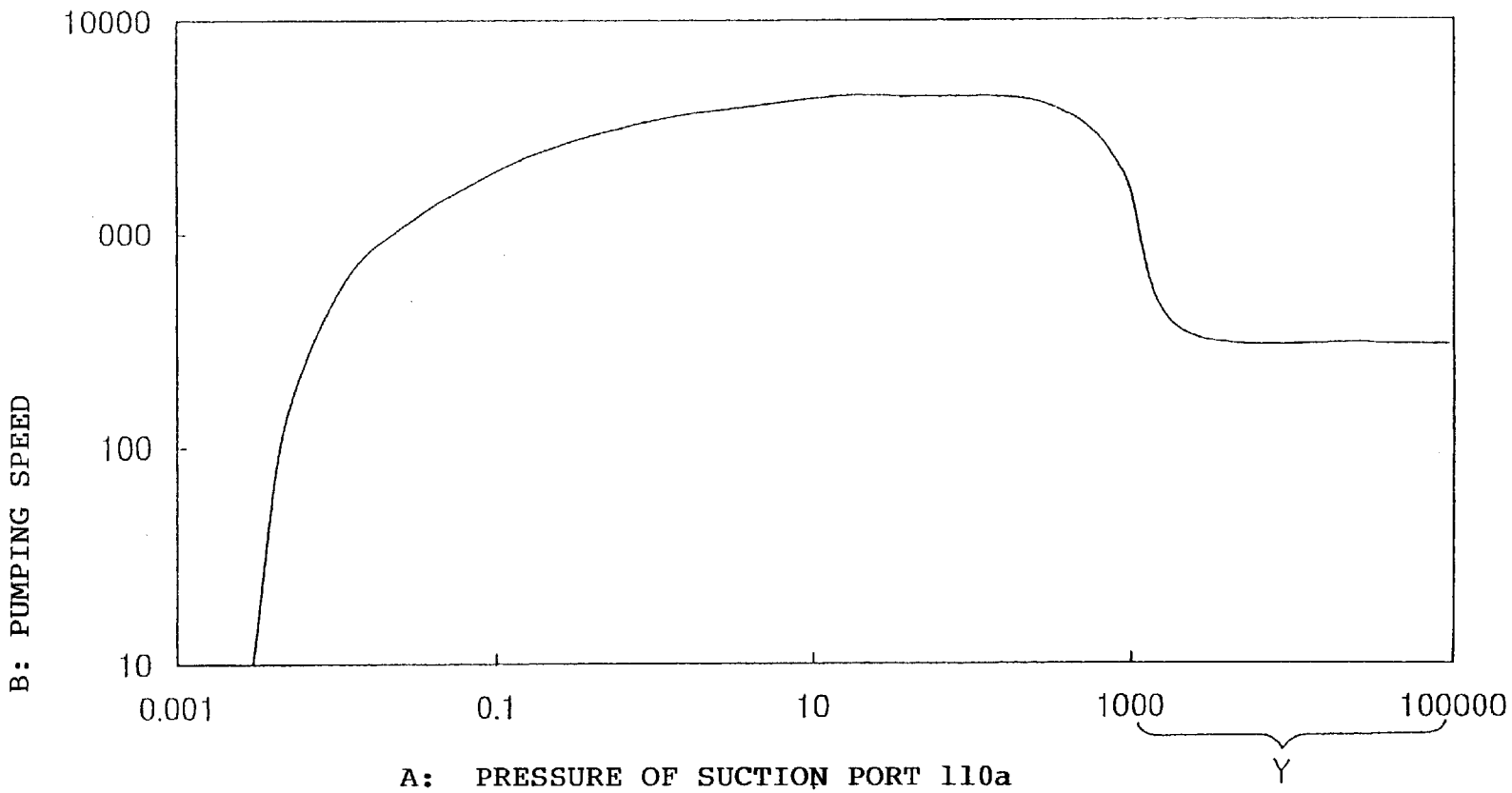
FIG. 7 is a graph of relation between the suction side pressure and the pumping speed of the evacuating apparatus according to the second embodiment of the invention.

FIG. 7 shows the relation between the suction port 110*a* pressure and the pumping speed in the evacuating apparatus 300. The roughing vacuum pump B is only operated in a region Y in the figure. The pumping speed in this region is equal to the pumping speed of the roughing vacuum pump B. When the pressure of the suction port 110*a* has reached about 1,000 Pa, the operation of the booster pump A is started. Then, the pumping speed of the evacuating apparatus 300 can get the same pumping speed as the booster pump A. When the evacuating apparatus is used for semiconductors, because the required operation area is roughly 1 to 1000 Pa, the roughing vacuum pump is only used to exhaust from the atmospheric pressure to about 1000 Pa, to suppress the amount of consumption power.

(Operation Method 2)

The consumption motive power W of each of the male and female rotors in the screw vacuum pump is given by, $$W=a\times T\times N$$

as represented in a general expression of (1) previously described. From this expression, it can be found that by designing the design pumping speed of the roughing vacuum pump B to be smaller than that of the booster pump A, the rotating speed N of each of the male and female rotors may be decreased, to further reduce the consumption motive power W, in the state where the torque T is already small. Thus, how to decrease the rotating speed N while fully maintaining the evacuation ability of the evacuating apparatus 300 in this embodiment will be described below.

Figure 8:
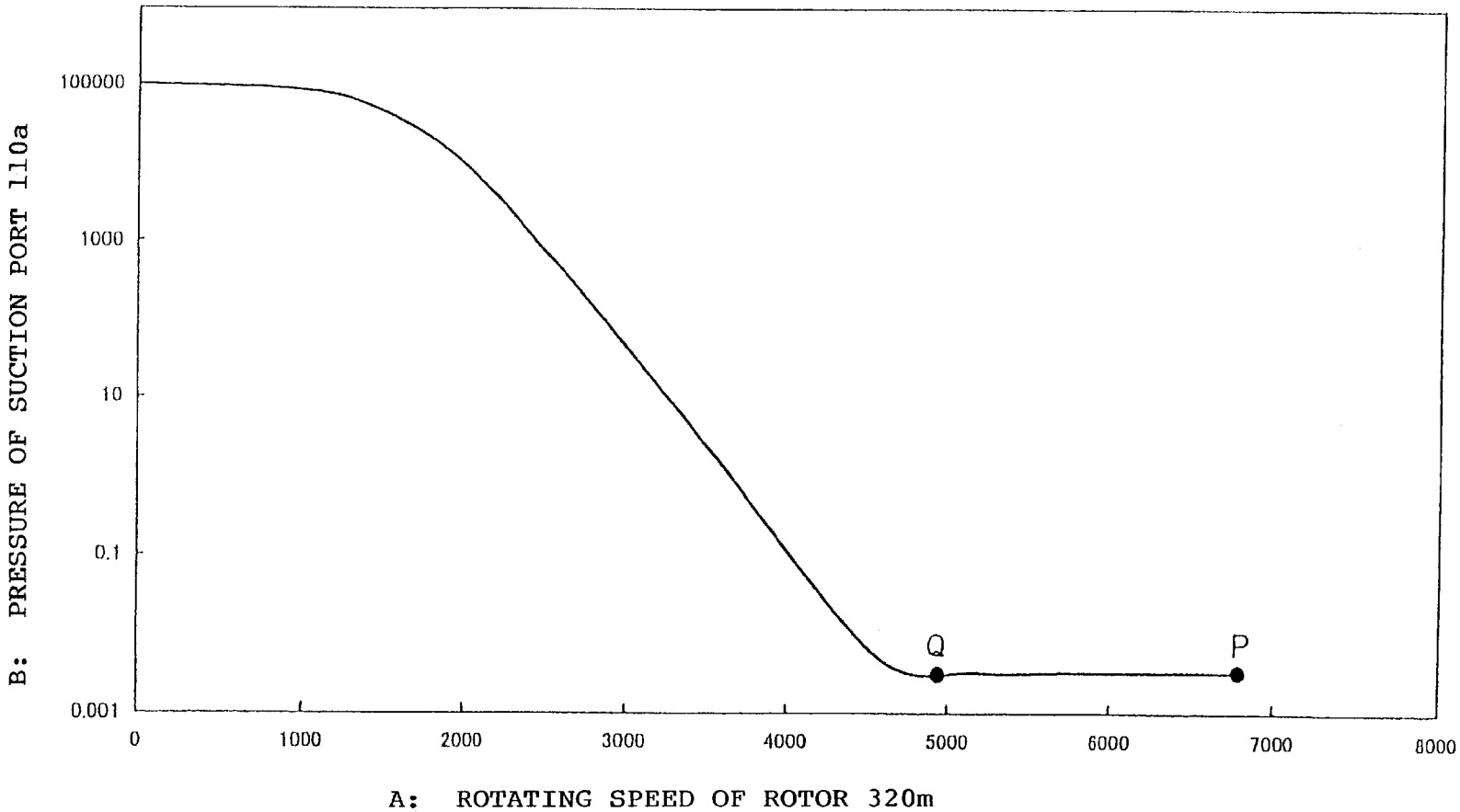
FIG. 8 is a graph of relation between the suction side pressure and the rotating speed of a motor 343 when no gas is flowed through the suction side of a booster pump A according to the second embodiment of the invention.

FIG. 8 shows the relation between the rotating speed of the male rotor 320*m* and the suction port 110*a* pressure when the booster screw pump A is at the ultimate pressure. As seen from this view, at the ultimate pressure, the suction pressure is not changed even if the rotating speed is reduced from point P to point Q. From this relation, it can be found that the rotating speed may be taken at point Q to maintain the ultimate pressure.

Figure 9:
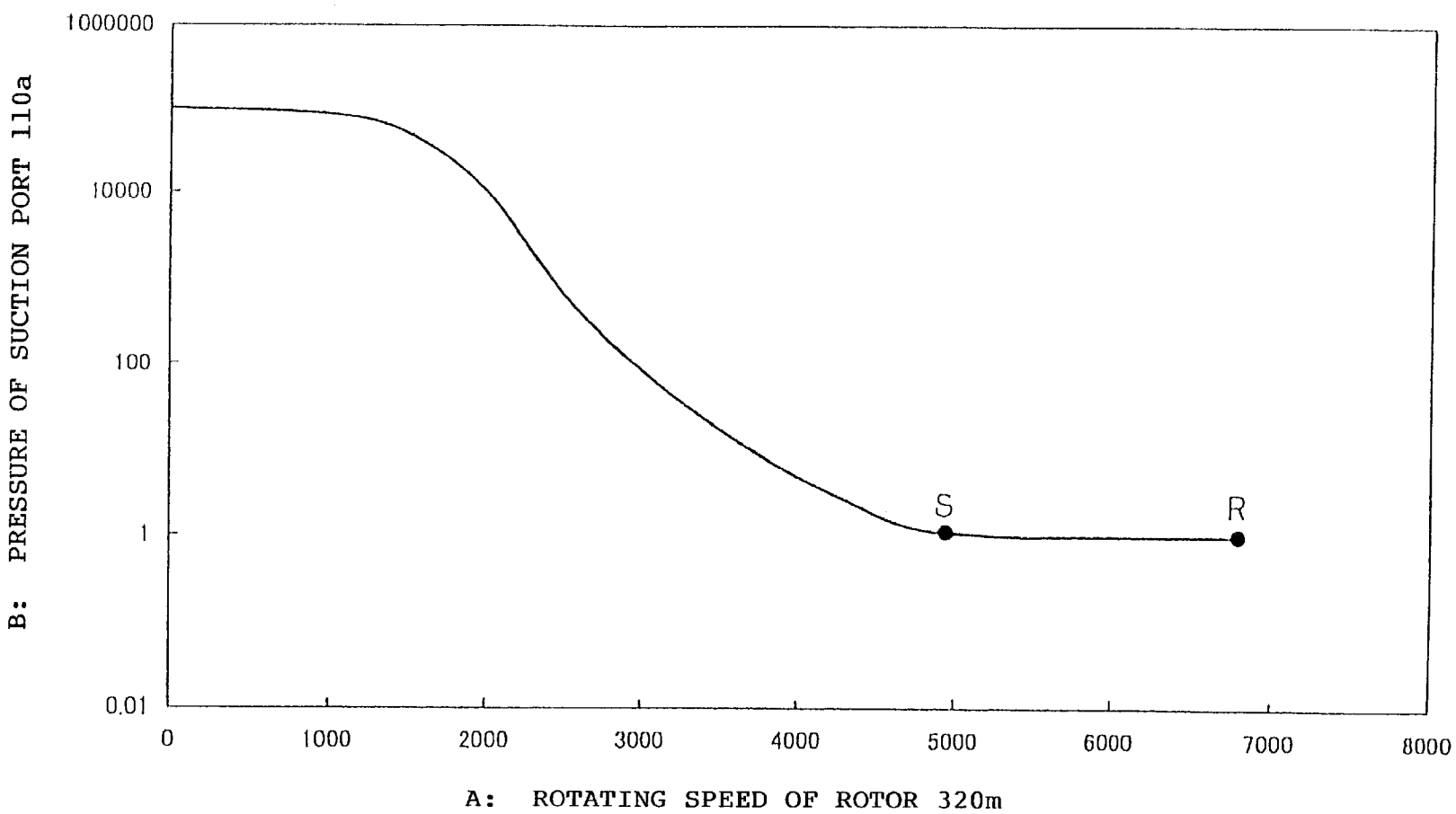
FIG. 9 is a graph of relation between the suction side pressure and the rotating speed of the motor 343 when a small amount of gas is flowed through the suction side of the booster pump A according to the second embodiment of the invention.

FIG. 9 shows the relation between the rotating speed of the male rotor 320*m* and the suction port 110*a* pressure in a state where a gas is flowed at 0.1 SLM (standard liter per minute) to the side of the suction port 110*a* in the booster screw pump A. From this view, it can be found that the rotating speed can be reduced from point R to point S, in the condition where a small amount of gas is flowed to the suction port 110*a,* in the same way as previously described.

From the above description, it can be found that there is the optimal rotating speed in accordance with the pressure condition at the suction port 110*a*. The rotating speed is necessary to retain a pumping speed appropriate to exhaust totally an amount of gas leaking from the roughing vacuum pump B into the booster pump and an amount of gas leaking through the suction port 110*a* into the booster pump A. Accordingly, the booster pump A controls the rotating speed in accordance with the pressure at the suction port 110*a,* so that the consumption power under each pressure condition can be minimum.

Figure 10:
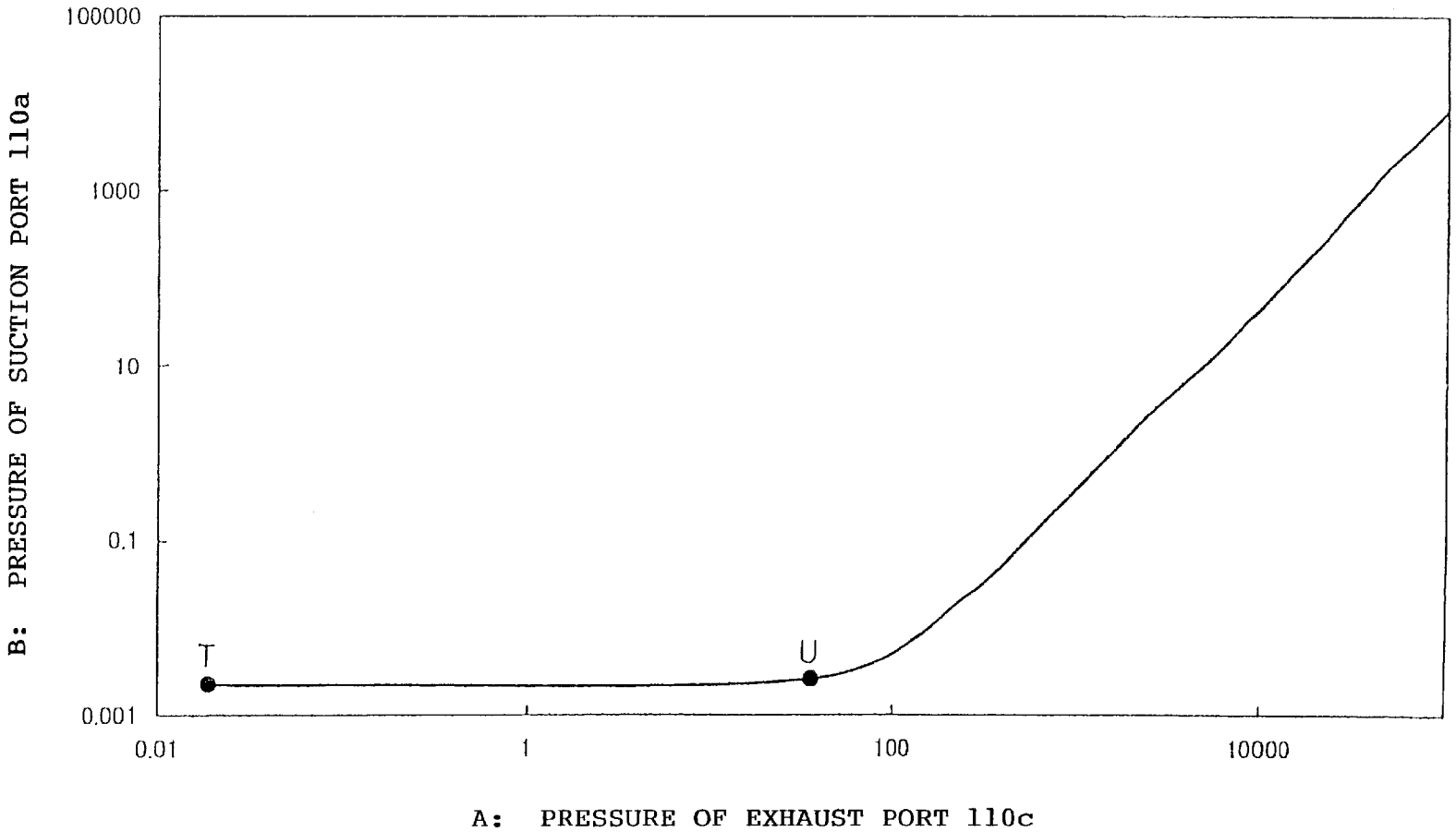
FIG. 10 is a graph of relation between the suction side pressure and the exhaust side (or the suction side of the roughing vacuum pump) of the booster pump A according to the second embodiment of the invention.

FIG. 10 shows the relation between the suction side pressure and the exhaust side pressure (or suction side of the roughing vacuum pump) of the booster pump A. As seen from this graph, the suction pressure of the booster pump A does not change in a range where the exhaust side pressure lies from point T to point U. The pressure at point U is called a critical backing pressure.

In the system of this embodiment, the critical back pressure of the booster pump A is maintained by the roughing pressure B. Accordingly, the rotating speed of the roughing vacuum pump B can be lowered to such an extent that the exhaust side pressure (i.e., suction side of the roughing vacuum pump) of the booster pump A can be kept below the critical backing pressure (point U). Thus, the consumption power can be minimum as required.

(Operation Method 3)

The above operation method 2 is involved in a case where the suction port 110*a* side of the evacuating apparatus 300 has reached the ultimate pressure or become a certain degree of vacuum. On the other hand, when the evacuating apparatus 300 exhausts a vacuum vessel connected at the suction port 110*a* from the atmospheric pressure, to evacuate it in a short time (e.g., to about 1000 Pa) may be often demanded. To cope with such a demand, each of the motors for driving the booster pump A and the roughing vacuum pump B is controlled to attain as high a rotating speed as possible within its capacity range at every moment. Thus, it is possible to exhaust the vessel more efficiently and fast than when the rotating speed of each of the pumps A, B is not controlled.

(Operation Method 4)

In exhausting the vessel from the atmospheric pressure, the exhaust time may be slow, but when it is desired that the motive power at every moment is suppressed low, the rotating speed of each of the motors for the pumps A, B is made as low as possible, and the rotating speed may be increased when the suction side pressure of each pump falls.

The operation methods 2 to 4 will be summarized as follows.

1. Booster Pump a) When the pressure on the side of the suction port 110*a* has reached the ultimate pressure or become a certain degree of vacuum (e.g., about 10 Pa), the rotating speed of the screw rotors 320*m,* 320*f* is controlled to be a minimum rotating speed at which the suction port side pressure can be maintained.

b) In exhausting a vacuum vessel connected at the suction port 110*a* from the atmospheric pressure.

1) When it is desired to shorten the exhaust time, the rotating speed of the screw rotors 320*m,* 320*f* is controlled to be as high as possible at every moment within a range of the driving motor capacity for the booster pump A.

2) When it is desired to suppress the momentary motive power low, the rotating speed of the screw rotors 320*m,* 320*f* is controlled to be as low as possible, and to be increased with the decreasing pressure at the suction port 110*a*.

2. Roughing Vacuum Pump a) When the pressure on the side of the suction port 110a for the booster pump A has reached the ultimate pressure or become a certain degree of vacuum (e.g., about 10 Pa), the rotating speed of the screw rotors 350*m,* 350*f* is controlled to be a minimum rotating speed so that the exhaust side pressure (or suction side pressure of the roughing vacuum pump) of the booster pump A can be maintained below the critical backing pressure of the booster pump.

b) In exhausting the vacuum vessel connected at the suction port of the booster pump A from the atmospheric pressure.

1) When it is desired to shorten the exhaust time, the rotating speed of the screw rotors 350*m,* 350*f* is controlled to be as high as possible at every moment within a range of the driving motor capacity for the roughing vacuum pump B.

2) When it is desired to suppress the momentary motive power low, the rotating speed of the screw rotors 350*m,* 350*f* is controlled to be as low as possible, and to be increased with the decreasing pressure at the suction side (or the exhaust side of the booster pump A).

The consumption motive power of the evacuating apparatus can be minimized by employing the operation methods as summarized above, so that the energy efficiency can be improved.

In the above embodiment, the screw vacuum pump is applied to both the booster pump and the roughing vacuum pump. However, as the application or variation of the present invention, a pump with a high compression ratio such as a screw pump may be employed as the booster pump, and a scroll pump may be employed as the roughing vacuum pump.

In the above embodiment, the lead angle of the roughing screw pump is not changed axially. However, the lead angle may be decreased stepwise toward the exhaust port side as shown in FIG. 11. Thus, the consumption motive power can be further reduced.

As described above, with an evacuating apparatus of the present invention, each of a roughing vacuum pump and a booster pump is constituted by a screw vacuum pump, wherein the design pumping speed of the roughing screw vacuum pump is sufficiently smaller than the design pumping speed of the booster screw vacuum pump, but adequate to be operable as the roughing vacuum pump, and the number of turns of screw for the booster screw vacuum pump is less than the number of turns of screw for the roughing screw vacuum pump, so that the evacuating apparatus with a simple structure, less consumption power, and a high vacuum ultimate pressure, and capable of easy maintenance can be provided.

What is claimed is:

1. An evacuating apparatus having a roughing vacuum pump and a booster pump, each of which is constituted of a screw vacuum pump, wherein design pumping speed of the roughing screw vacuum pump is sufficiently smaller than design pumping speed of the booster screw vacuum pump, but adequate to be operable as the roughing vacuum pump, and the number of turns of screw of said booster screw vacuum pump is smaller than the number of turns of screw of said roughing screw vacuum pump.

2. An evacuating apparatus according to claim 1, wherein the design pumping speed of said roughing screw vacuum pump is ⅕ to 1/100 the design pumping speed of said booster screw vacuum pump.

3. An evacuating apparatus according to claim 1, wherein the number of turns of screw of said booster screw vacuum pump is substantially one, or a number of turns at which at least one gas transfer chamber which is in communication with neither a suction port nor an exhaust port of said booster pump is formed.

4. An evacuating apparatus according to claim 3, wherein the number of turns of screw of said roughing screw vacuum pump is 3 to 10.

5. An evacuating apparatus according to claim 1, wherein screw lead angle of said booster screw vacuum pump is larger than screw lead angle of said roughing screw vacuum pump.

6. An evacuating apparatus according to claim 1, wherein said roughing screw vacuum pump is only driven until the pressure on the suction side of said booster screw vacuum pump falls from the atmospheric pressure to about 13,300 Pa, and said booster pump starts to be driven when the pressure on the suction side of said booster screw vacuum pump falls below about 13,300 Pa.

7. An evacuating apparatus according to claim 1, wherein each of the drive motors of said booster screw vacuum pump and said roughing screw vacuum pump is rotated at as high a rotating speed as possible to shorten the exhaust time in a range where the pressure on the suction side of said booster screw vacuum pump is relatively high, the rotating speed of a driving motor for said booster screw vacuum pump is reduced to a minimum rotating speed to maintain a required degree of vacuum, when the pressure on the suction side of said booster screw vacuum pump has reached an ultimate pressure or a relatively low pressure, and the rotating speed of a driving motor for said roughing screw vacuum pump is reduced to a speed as low as possible in a range where the back pressure of said booster pump can be maintained below its critical backing pressure, thereby decreasing a necessary motive power.

* * * * *